United States Patent [19]

Samoilov

[11] 4,135,458

[45] Jan. 23, 1979

[54] NEEDLE HOLDER

[76] Inventor: Constantin Samoilov, 237 N. Front St., Woodburn, Oreg. 97071

[21] Appl. No.: 859,202

[22] Filed: Dec. 9, 1977

[51] Int. Cl.[2] ..... D05C 15/06

[52] U.S. Cl. ..... 112/80

[58] Field of Search ..... 112/80, 78, 169, 48; 128/340; 223/104; 69/20; 12/103

[56] References Cited

U.S. PATENT DOCUMENTS

| | | | |
|---|---|---|---|
| 313,710 | 3/1885 | Connett, Jr. | 112/80 |
| 1,357,687 | 11/1920 | Butler | 112/80 |
| 1,398,004 | 11/1921 | Cluff | 112/80 |
| 1,469,906 | 10/1923 | Hansen | 112/80 |
| 2,610,598 | 9/1952 | Midas | 112/80 |

*Primary Examiner*—H. Hampton Hunter
*Attorney, Agent, or Firm*—Klarquist, Sparkman, Campbell, Leigh, Hall & Whinston

[57] ABSTRACT

A holder for an embroidery needle has an elongated body divided into a forward needle-retaining portion and a rearward handle portion. The retaining portion includes a wall which forms a bed for receiving the handle portion of a needle and a narrow passageway extending forwardly from the bed for receiving the shank of a needle with the needle tip protruding from the forward end of the retaining portion. The bed has longitudinally spaced transverse grooves for receiving the projecting rim of a needle handle to prevent longitudinal movement of the needle relative to the holder. The groove selected for seating the rim determines the extent to which the needle tip projects from the forward end of the holder. The wall of the retaining portion is open along one side to provide access for inserting the needle into the bed and passageway. A cap slides over the retaining portion to enclose the bed and passageway and thereby retain the needle in its selected groove.

12 Claims, 7 Drawing Figures

NEEDLE HOLDER

BACKGROUND OF THE INVENTION

1. Field of the Invention

The present invention relates to embroidery needles, and more particularly to an adjustable needle holder for retaining and facilitating use of the needle.

2. Description of the Prior Art

Embroidery needles generally are made with some sort of fixed handle for gripping the needle while embroidering. However, most embroidery needles are quite small; and its handle is also small, making it very difficult to securely grip. Furthermore, in the conventional loop-type embroidery needle the distance between the needle handle and the needle tip is fixed. However, it is desirable to have an adjustable distance between the needle tip and handle or other stop means because it is this distance which determines the depth of penetration of the needle into the embroidered fabric and thus the size of the embroidery loop formed in the fabric.

Others have suggested holders for embroidery needles which provide enlarged handles to facilitate gripping and handles which are adjustable relative to the needle shank and tip to control the size of the embroidery loop formed. However, such prior embroidery needle handles or holders which are adjustable have one common disadvantage. They all require a custom manufactured needle and holder specially fitted for one another. Another common disadvantage of the prior adjustable needle holders is that the adjustment mechanism is complex and usually combines adjustability features which must be designed into both the needle and the holder or handle.

Examples of needle-and-holder devices of the prior art having the aforementioned disadvantages are shown in U.S. Pats. Nos. 2,097,380; 2,565,135; 2,319,442; and 1,469,906.

Accordingly, there is a need for a simple, low-cost needle holder capable of holding an existing popular type of embroidery needle having an integral rimmed handle, with the holder being large enough to facilitate gripping and being capable of adjusting the distance between the needle tip and the forward end of the holder for controlling the size of the embroidery loop formed by the needle.

SUMMARY OF THE INVENTION

The present invention is a simple, two-piece needle holder for accomodating an existing embroidery needle with an integral rimmed needle. The holder is provided with unique means cooperable with the rim of the needle handle for adjusting the exposed length of the needle tip and thereby the size of the embroidery loop formed. The holder includes means for retaining the needle firmly within the needle holder in selected positions of adjustment. The holder is large enough for firm gripping by the user without slippage, and is also capable of storing the needle with its point shielded for safety when not in use.

Principal objects of the invention are to provide a needle holder:

1 that is large enough to provide a firm nonslip grip;

2 that is adjustable for controlling the exposed length of the needle;

3 that is simple and inexpensive to manufacture;

4 that is easy to use;

5 that firmly grips the needle in its selected position of adjustment so that the needle in use will not rotate or shift longitudinally or laterally relative to the holder;

6 that provides easy access for inserting and removing a needle from the holder;

7 that stores the needle with its point shielded when the needle is not in use; and 8 that is operable without modification of the needle itself.

Another principal object is to provide a combination embroidery needle and needle holder which is adjustable to vary the exposed length of the needle shank in use.

Principal features of the invention include an elongated body divided transversely into a forward needle-retaining bed portion and a rearward hollow handle portion. The needle-retaining bed portion is open along one side for insertion of the needle into its bed. The bed has longitudinally spaced transverse grooves which receive a rimmed portion of the needle handle, thereby determining the extent to which the needle shank projects from the forward end of the holder. A cap slips over the retaining portion to enclose the bed and secure the needle rim in a selected groove. The contour of the bottom of each retaining groove conforms to the exterior contour of the needle rim so as to restrain the needle against rotation relative to the holder when the needle rim is inserted in one of the grooves.

The foregoing and other objects, features, and advantages of the invention will become more apparent from the following detailed description of a preferred embodiment which proceeds with reference to the accompanying drawings.

DETAILED DESCRIPTION OF PREFERRED EMBODIMENT

Figures 1, 2, 3, 4, 5, 6, 7:
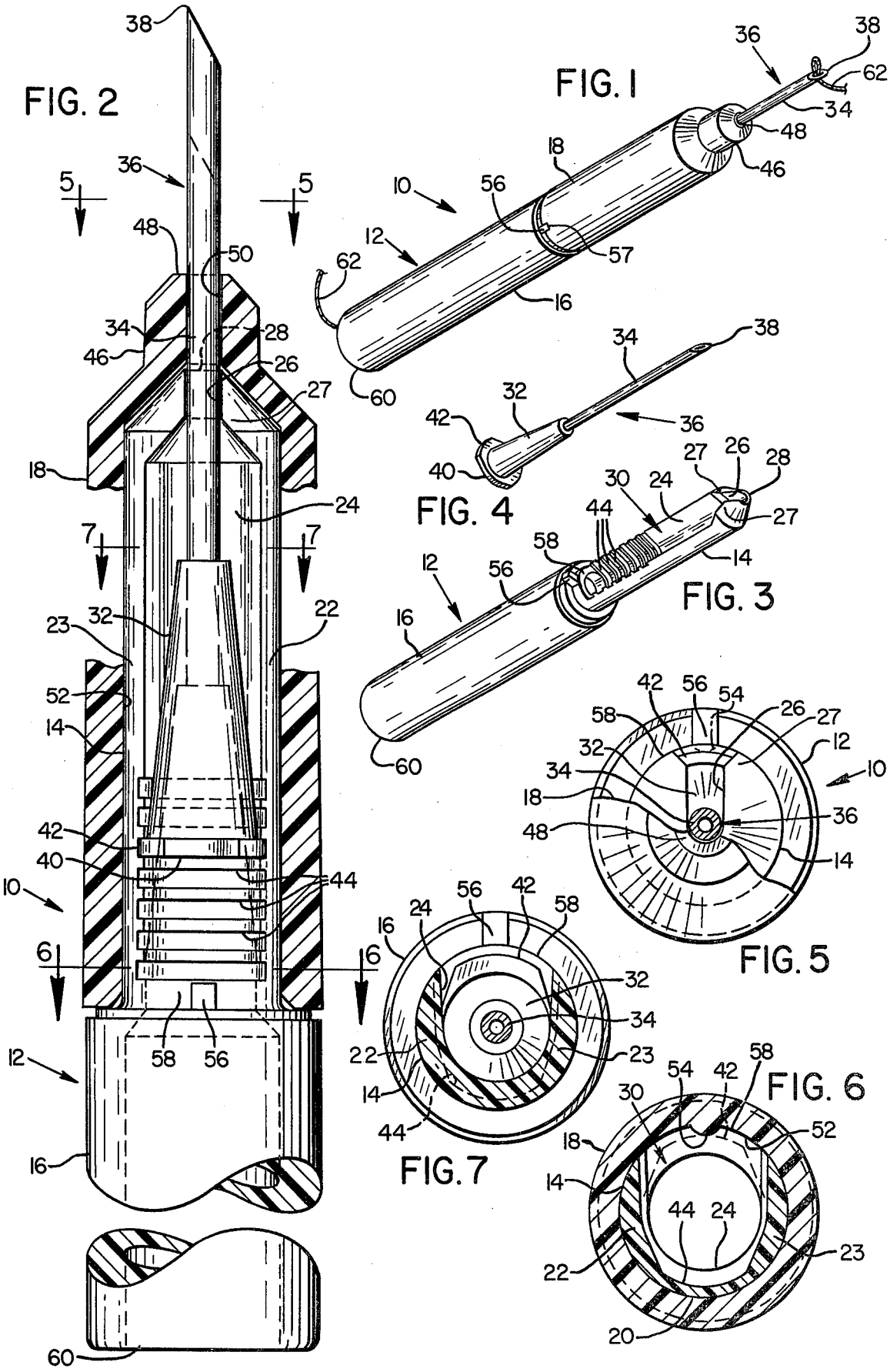
FIG. 1 is a perspective view of a needle holder of the invention with a needle installed therein.
FIG. 2 is an enlarged foreshortened view of the needle holder of FIG. 1 with its cap portion shown in longitudinal section to reveal the interior construction of the holder with a needle therein.
FIG. 3 is a perspective view similar to FIG. 1, but showing the forward end of the needle holder with its cap removed.
FIG. 4 is a perspective view of an embroidery needle which the holder of the invention is designed to hold.
FIG. 5 is a view taken approximately along the line 5—5 of FIG. 2 at the forward end of the needle holder but with a portion of the cap removed.
FIG. 6 is a cross-sectional view taken along the line 6—6 of FIG. 2.
FIG. 7 is a cross-sectional view taken along the line 7—7 of FIG. 2.

Referring to the drawings, the needle holder 10 includes an elongated body 12 divided transversely along its length into a forward needle-retaining portion 14 generally comprising a longitudinally sectioned right-circular cylinder and an integral rearward handle portion 16. The retaining portion 14 slidably receives a removable cap 18. Retaining portion 14 is formed by wall means including a bottom wall portion 20 and opposed upwardly extending sidewall portions 22, 23. The interior surfaces of the walls define a bed 24 and a narrow passageway 26 extending forwardly from the bed to the forward end 28 of the retaining portion. The sidewall portions 22, 23 through the major portion of their lengths terminate at their upper ends to define an elongated wide access opening 30 into the bed. However, at their forward ends at 27 walls 22, 23 taper inwardly and extend upwardly and inwardly beyond the more rearward portions thereof to define the narrow passageway 26 for inserting and removing an embroidery needle 36 therefrom.

The bed 24 and passageway 26 are sized to receive respectively the handle 32 and shank 34 of needle 36 with the sharp point 38 and forward portion of shank 34 projecting from the forward end of the retaining portion and cap of the needle holder. Needle handle 32 is generally cone-shaped and hollow and fixed to the shank 34. Such handle terminates at an open end 40 having a radially projecting rim 42. The shank 34 of the needle is hollow so that embroidery thread can be threaded from the open handle end 40 of the needle through the shank to tip 38. The shape of the needle itself is shown in my copending design patent application Ser. No. 707,878, filed July 22, 1976, and is also shown in perspective in FIG. 4.

The surface of bed 24 is provided with transverse grooves 44 at longitudinally spaced intervals along its length. The grooves are sized and shaped to receive the rim 42 of needle handle 32. Thus by inserting the needle rim 42 in a selected groove 44, the length of the projecting portion of the needle shank 34 from the forward end of the needle holder can be determined and controlled. The more forward the groove selected, the greater will be the projecting length of the needle from the holder; conversely, the more rearward the groove selected, the less will be the projecting length of the needle from the holder, whereby the size of the loop formed during the embroidery process can be selected.

Furthermore, as will be evident from FIG. 6, each groove 44 extends continuously along both sidewalls 22, 23 and bottom wall 20 of the bed 24. The bottom of each groove is contoured to conform with the external profile or contour of needle rim 42. Moreover, the needle rim itself is noncircular so that when it is seated in one of the holder grooves 44, the rim and thus the needle itself cannot rotate in the bed.

Cap 18 is generally of tubular cylindrical shape and is sized to slidably fit over the generally cylindrical outer surface of the walls forming the retaining portion of the holder, thereby enclosing bed 24 and passageway 26 and retaining the needle in a selected position in its bed. Cap 18 has a forward portion 46 of reduced diameter terminating at a forward end 48. A small through-opening 50 extends centrally through forward cap portion 46 and is just large enough to permit needle shank 34 to pass therethrough, thereby to enable the cap to be slipped over the needle and retaining portion of the needle holder.

Cap 18 has a cylindrical interior bore 52 with an elongated convex bead 54 extending along such bore. Only when bead 54 is aligned with passageway 26 and access opening 30 can cap 18 be easily slipped over and onto retaining portion 14. The inner rim of the cap also has a small notch 57 (FIG. 1) aligned with bead 54. The notch receives a rib 56 which extends radially from a rear cylindrical wall portion 58 of retaining portion 14 to lock the cap against rotation when covering such portion. When bead 54 is thus properly aligned, it engages the outermost edge of needle rim 42 in the manner shown in FIG. 6, thereby restraining the needle against lateral and rotational movement in its bed when the cap is properly in place on the retaining portion.

Referring to FIGS. 1 and 2, the handle portion 16 of holder body 12 is of hollow cylindrical shape from its open rear end 60 to its open forward end which communicates with the interior bed space of retaining portion 14. The outer diameters of handle 16 and cap 18 are about the same so that when the cap is installed on retaining portion 14, it forms a smooth continuation of the handle portion.

Handle portion 16 is open at its rear end 60 so that an embroidery thread 62 can be threaded from the rear end completely through the hollow handle portion 16 and into the interior bed space of the retaining portion, where the thread passes into the hollow handle 32 of needle 36 and thence through hollow needle shank 34 to its point 38. With the thread thus threaded through the holder and needle, the needle is ready for use in the known manner.

When the needle is not in use, cap 18 is removed and the needle reversed end-for-end in its bed. With the needle rim 42 seated in one of bed grooves 44, the shank and point of the needle extend into the hollow handle 16 to shield the sharp needle point. The cap is then replaced on the retaining portion to lock the needle in place so that it cannot slip out of the holder through hollow handle portion 16. This unique storage feature eliminates the need for a separate cover to shield the needle point when the needle is not in use.

The needle holder as shown and described can be made of a moldable, synthetic material and formed by any of several well-known plastics molding processes, such as injection molding.

Having illustrated and described the principles of my invention by what is presently a preferred embodiment, it should be apparent to those having skill in the art that such embodiment can be modified in arrangement and detail without departing from such principles. I claim as my invention all such modifications as come within the true spirit and scope of the following claims.

I claim:

1. A holder for an embroidery needle or the like having a needle shank extending from a needle point to a rimmed needle handle, said holder comprising:

an elongated body divided transversely along its length into a forward needle-retaining portion and a rearward handle portion, said retaining portion comprising wall means defining a bed for the needle and a narrow passageway extending forwardly from the bed to a forward end of said retaining portion for receiving the needle shank, said wall means extending lengthwise of said retaining portion and terminating at opposed upper edges to define an access opening to said bed and passageway, said bed including a bed surface having a series of longitudinally spaced-apart transversely extending grooves to seat the rim of a needle handle at selected positions along the length of said bed so as to control the extent to which the needle shank and tip project from the forward end of said retaining portion, and a cap means for enclosing said bed and passageway to retain said needle in a selected position, said cap means being longitudinally separable from and adapted to be slidably received over said wall means and including a forward end opening through which the shank and tip of a needle retained in said bed projects.

2. A device according to claim 1 wherein said wall means include a bottom wall portion and opposed sidewall portions extending upwardly from said bottom wall portion, each of said grooves extending continuously along said opposite sidewall portions and said bottom wall portion.

3. A device according to claim 2 wherein the depth of each groove along said sidewall portions is less than the depth thereof along said bottom wall portion.

4. A devide according to claim 2 wherein the contour of the bottom of each groove conforms to the contour of the rim of the needle to be seated within such groove.

5. A device according to claim 1 wherein said handle portion and said cap means are both of generally cylindrical configuration and are of substantially the same outer diameters throughout the major portion of their respective lengths so that said cap means when on said retaining portion forms a continuation of said handle portion.

6. A device according to claim 1 wherein said cap means is of generally tubular configuration and includes a bore with a longitudinally extending bead means along a major portion of the length of said bore for engaging the needle rim and thereby restraining a needle against movement within said bed.

7. A device according to claim 6 wherein said cap means includes a notch means cooperable with a corresponding rib means on said retaining portion for locking said cap against rotation on said portion and thereby properly positioning said bead means to restrain a needle.

8. A device according to claim 1 wherein said handle portion is a fully enclosed integral tubular rearward continuation of said retaining portion and communicates with the bed space of said retaining portion such that a needle can be reversed in said bed whereby the needle point and shank extend into said handle portion for storage.

9. In combination, an embroidery needle and needle holder therefor, said embroidery needle including a hollow shank portion terminating at a point at one end and at an enlarged handle at the other end, said handle having a pronounced radial rim, said needle holder including a forward needle-retaining portion and a rearward handle portion, said retaining portion including wall means defining a bed removably receiving said needle handle portion and a narrow passageway extending forwardly from said bed to a forward end of said retaining portion removably receiving said needle shank portion, said bed including a bed surface having longitudinally spaced transverse grooves for removably receiving the rim of said needle handle to restrain said needle against longitudinal movement within said retaining portion, said wall means terminating at laterally opposed longitudinally extending upper edges to define an access opening for inserting and removing said needle from said bed and passageway, and cap means slidably receivable over said wall means for enclosing said bed and passageway and thereby retaining said needle rim in a selected one of said grooves.

10. The combination of claim 9 wherein said handle portion and needle portion are integral with one another.

11. The combination of claim 9 wherein said handle portion is hollow and in communication with the bed space of said retaining portion, said needle being reversible in said bed so that the shank and point of said needle extend into said handle for storage.

12. The combination of claim 9 wherein said needle rim has a noncircular profile and the bottoms of said bed grooves have a corresponding noncircular contour so that with said rim seated in one of said grooves said needle is restrained against rotation.

* * * * *